US011737553B2

(12) United States Patent
Magni et al.

(10) Patent No.: US 11,737,553 B2
(45) **Date of Patent: *Aug. 29, 2023**

(54) DEVICE FOR PRODUCING ROUND BRUSHES

(71) Applicant: BORGHI S.p.A., Castelfranco Emilia (IT)

(72) Inventors: Ettore Magni, Castelfranco Emilia (IT); Enzo Ferrari, Castelfranco Emilia (IT)

(73) Assignee: BORGHI S.P.A.

( * ) Notice: Subject to any disclaimer, the term of this patent is extended or adjusted under 35 U.S.C. 154(b) by 231 days.

This patent is subject to a terminal disclaimer.

(21) Appl. No.: 17/152,875

(22) Filed: Jan. 20, 2021

(65) Prior Publication Data

US 2021/0137260 A1 May 13, 2021

Related U.S. Application Data

(63) Continuation of application No. 16/096,831, filed as application No. PCT/EP2017/059268 on Apr. 19, 2017, now Pat. No. 10,932,558.

(30) Foreign Application Priority Data

Apr. 27, 2016 (DE) ..... 10 2016 107 839.5

(51) Int. Cl.
*A46D 3/05* (2006.01)
*A46D 9/02* (2006.01)
(Continued)

(52) U.S. Cl.
CPC ..... *A46D 3/05* (2013.01); *A46B 3/08* (2013.01); *A46B 3/18* (2013.01); *A46B 9/026* (2013.01); *A46D 3/08* (2013.01); *A46D 9/02* (2013.01)

(58) Field of Classification Search
CPC ... A46D 3/05; A46D 3/08; A46D 9/02; A46D 1/08; A46D 1/04; A46D 9/00; A46D 3/04;
(Continued)

(56) References Cited

U.S. PATENT DOCUMENTS 2,483,627 A 10/1949 Dale
3,254,923 A * 6/1966 Marks ..... A46D 3/05 140/149
(Continued)

FOREIGN PATENT DOCUMENTS

CN 101099616 A 1/2008
CN 102687950 A 9/2012
(Continued)

OTHER PUBLICATIONS

Office Action issued in German Patent Application No. 10 2016 015 939.1, dated Aug. 13, 2021, 7 pages.

*Primary Examiner* — Robert J Scruggs
(74) *Attorney, Agent, or Firm* — Dilworth IP, LLC

(57) ABSTRACT

A method and apparatus for producing round brushes having bristles clamped between two wire portions of a folded wire, comprising a feed station and a subsequent finishing station, wherein in the feed station a wire is bent between two counter holders, and the feed station comprises a bristle feed device and a rotatable gripper adapted to grip the bent wire and twist it during the feed of bristles to anchor the bristles in the wire. In the finishing station, the twisted wire is held by a stationary gripper and further twisted by the rotatable gripper. The bristles are then cut on their outer side.

16 Claims, 4 Drawing Sheets

(51) Int. Cl.

| | |
|---|---|
| ***A46B 3/18*** | (2006.01) |
| ***A46D 3/08*** | (2006.01) |
| ***A46B 3/08*** | (2006.01) |
| ***A46B 9/02*** | (2006.01) |

(58) Field of Classification Search
CPC .... A46D 3/00; A46B 3/08; A46B 3/18; A46B 9/026; A46B 9/02; B21F 45/00; B21F 7/00; A47G 33/06
See application file for complete search history.

(56) References Cited

U.S. PATENT DOCUMENTS

| | | | | |
|---|---|---|---|---|
| 6,289,902 | B1 * | 9/2001 | Mathiez | A46B 3/18 401/128 |
| 6,651,675 | B2 | 11/2003 | Mathiez | |
| 8,020,942 | B2 | 9/2011 | Manici | |
| 8,915,551 | B2 * | 12/2014 | Rees | A46D 3/05 300/2 |
| 10,932,558 | B2 * | 3/2021 | Magni | A46B 3/18 |
| 2002/0007837 | A1 | 1/2002 | Mathiez | |
| 2005/0242655 | A1 * | 11/2005 | Romagnoli | A46D 3/082 300/2 |
| 2008/0023024 | A1 | 1/2008 | Manici et al. | |
| 2012/0240347 | A1 | 9/2012 | Rees et al. | |

FOREIGN PATENT DOCUMENTS

| | | | |
|---|---|---|---|
| DE | 19963600 | B4 | 8/2010 |
| DE | 102011015060 | A1 | 9/2012 |
| EP | 1917886 | A1 | 5/2008 |

* cited by examiner

DEVICE FOR PRODUCING ROUND BRUSHES

FIELD OF THE INVENTION

The invention relates to an apparatus and a method for manufacturing round brushes.

BACKGROUND

Round brushes are manufactured by first folding a wire and then clamping bristles between the twisting wire halves during a twisting process.

Such an apparatus operates at extremely high speeds, and the wire must first be bent slightly from a linear shape near its center, whereupon a rotatable gripper can grasp it. The linear sections of the wire that have not yet been bent are drawn into the twisting area via deflection devices, because the rotatable gripper is usually also moved linearly, transversely to the longitudinal extension of the bent wire, so that a wire feed must take place.

It is the task of the invention to disclose a device and a method for producing round brushes which enable a high cycle rate.

SUMMARY

The present invention provides an apparatus for manufacturing round brushes that include bristles clamped between two wire portions of a folded wire, comprising a feed station and a subsequently arranged finishing station, the feed station having two opposed counter-brackets spaced apart from each other, a bristle feeding device and a rotatable gripper, the feed station being designed to bend a wire, which is transported into the feed station, transversely to a longitudinal direction of the wire between the opposed counter-brackets, the bristle feeding device being designed to feed bristles to the bent wire, and the rotatable gripper being designed to grasp the bent wire and twist the same during the feeding of bristles in order to anchor the bristles in the wire, the finishing station being designed to receive the twisted wire and to further twists the wire and cut the bristles on an outer end of the bristles, the finishing station having a stationary gripper that can grasp a free end of the twisted wire, the apparatus having a rotatable base to which a plurality of rotatable grippers are attached and wherein by rotating the base a rotatable gripper together with the wire just twisted can be transferred from the feed station into the finishing station where the wire just twisted is grasped by the stationary gripper provided in the finishing station, wherein the rotatable gripper can be put into rotation for the further twisting, and wherein a milling cutter or a knife is provided in the finishing station for cutting bristles at the outer end.

A finishing station is provided, into which the twisted wire can be inserted and which further twists the wire and/or cuts the bristles on the outside.

The device provides effective results because the finishing station has a stationary gripper which can grasp the free ends of the wire halves. The apparatus can be rotated or pivoted, for example, it has a rotatable base to which a plurality of rotatable grippers are attached. By rotation, a rotatable gripper that has just been in use, together with the just-twisted wire that it is still gripping, is transferred from a feed station (which is the station with the counter-brackets and drive rollers) to the finishing station. There, the just twisted wire is gripped by the stationary gripper.

Furthermore, the present invention provides a method for producing round brushes.

Further features and advantages of the invention can be taken from the following description and from the following drawings to which reference is made.

DETAILED DESCRIPTION

Figure 1:
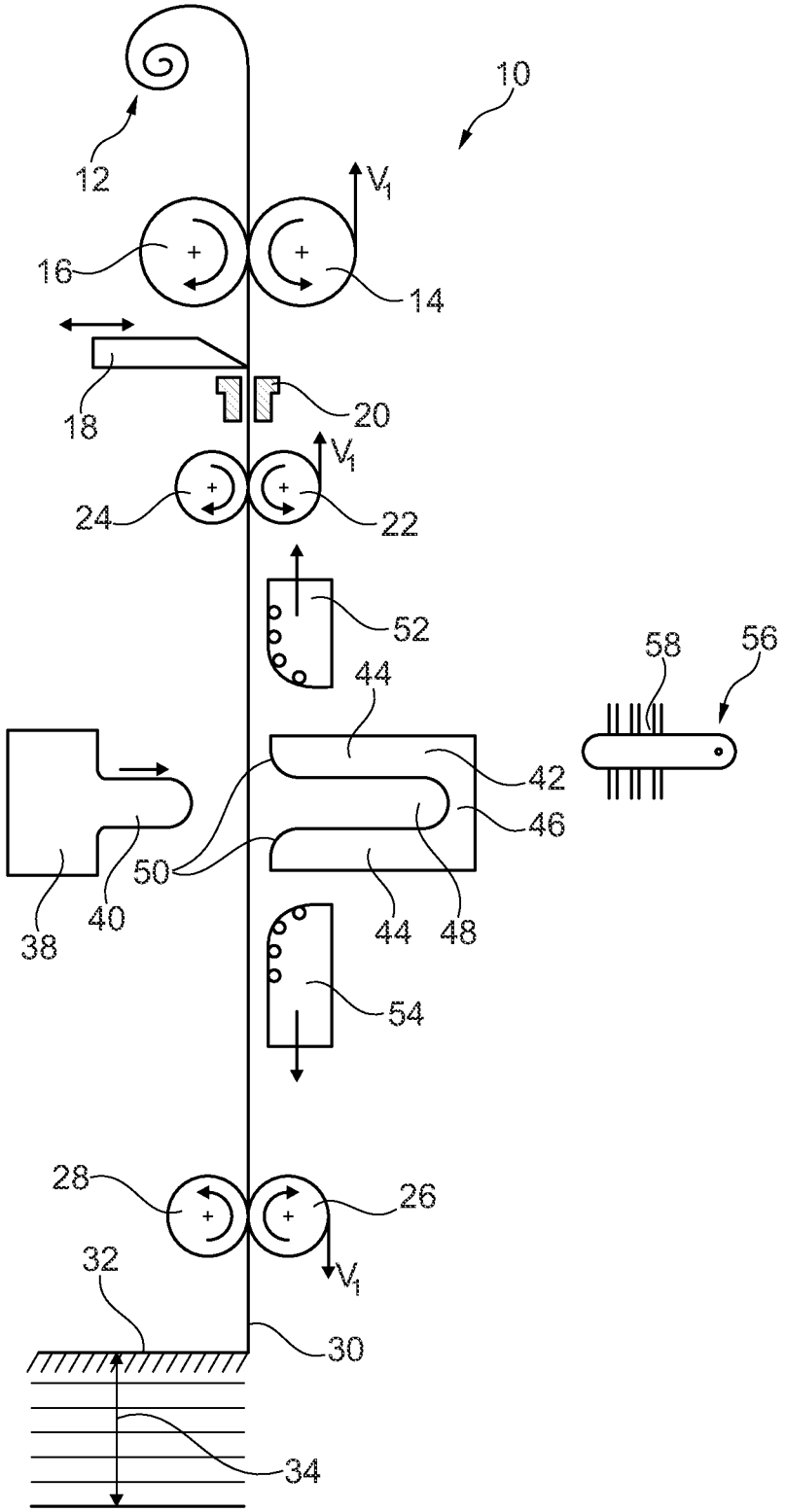
FIG. 1 shows a schematic view of an apparatus according to the invention for manufacturing round brushes.

FIG. 1 shows an apparatus 10 for manufacturing round brushes. For this purpose, a stylized supply 12 of wire is present, from which wire is withdrawn and transported into the apparatus. In the wire feed direction a motor-driven auxiliary drive roller 14 and a counter-roller 16 are provided, which form a pair of auxiliary drive rollers. Here, one or both of the rollers can be drivable. Between the rollers 14, 16 the wire is fed. After the pair of auxiliary drive rollers an adjustable knife 18 is present, which cuts off a sufficiently long piece of wire, as will yet be explained below.

A guide 20 serves to act as a counter-knife and at the same time guide the wire. After the guide 20 a first pair of drive rollers with a first motor-driven drive roller 22 and a counter-roller 24 is arranged, which receive the wire between themselves. A second pair of drive rollers distinctly spaced apart therefrom comprises a second motor-driven drive roller 26 as well as a counter-roller 28, which receive the free end of the wire 30 and for example move it up to a stop 32. As indicated with the arrows 34, the stop 32 is adjustable in order to be able to variably adjust the length of the wire piece between the knife 18 and the stop 32.

The wire 30 extends linearly between the first and the second pair of drive rollers and also up to the pair of auxiliary drive rollers, as is clearly shown in FIG. 1.

To bend the wire 30, the following devices are provided. A bending part 38 reciprocable transversely to the longitudinal direction of the wire or the longitudinal extension of the wire (linear extension in the unbent condition according to FIG. 1) has a trunnion 40.

This trunnion 40 faces the wire 30. On the side of the wire opposite to the trunnion 40, i.e. facing the trunnion, there is provided an integral bending jaw 42 that comprises two counter-brackets 44 spaced apart from each other, which are integrally connected to each other by a web 46 and form a gap 48 between themselves. The free ends of the counter-brackets each extend over an arc 50 that extends over substantially 90°, from the longitudinal direction of the wire 30 up to the gap 48, where the arc then substantially transitions into a portion that extends at 90° to the longitudinal direction of the wire 30.

In addition, there are provided two diverters 52, 54 that are adjustable in one or more directions and that likewise lie between the pairs of drive rollers. As will yet be explained below, these diverters 52, 54 are used when twisting the wire.

There is symbolically shown a bristle feeding device 56 that carries bristles 58, which one after the other are received and clamped between the wire halves that are formed.

Both the counter-brackets 42, i.e. the entire bending part 38, and the diverters 52, 54 are movable so that they get into action one after the other and are acted upon by the wire 30 one after the other in order to control its bend.

In FIG. 1, the motorically traversable diverters 52, 4 are out of engagement with the wire and not in operation. The counter-brackets 44 however are in operation, as will be explained in FIG. 2.

Figure 2:
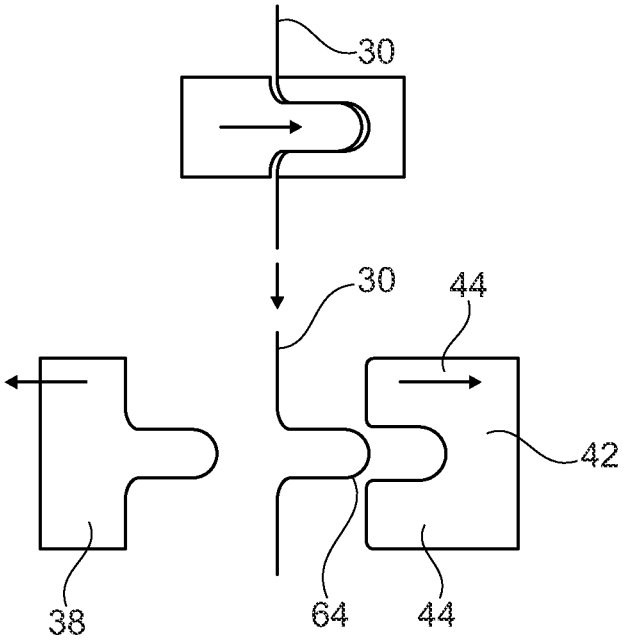
FIG. 2 shows the counter-bracket used in the apparatus according to the invention along with the bending part.

From the position shown in FIG. 1 the bending part 38 is moved in the direction of the bending jaw 42 in the direction of arrow so that the trunnion 40 grasps the wire in the region of its middle, i.e. with respect to the longitudinal extension, and presses the same between the counter-brackets 44, as shown in FIG. 2 at the top. As the trunnion 40 is configured complementary to the recess or to the gap 48, the shape of the bent or kinked portion of the wire 30 is produced very accurately (see FIG. 2). Subsequently, both the bending part 38 and the bending jaw 42 with the counter-brackets 44 is moved to the outside, as shown with the arrows in FIG. 2 at the bottom. The wire 30 then has a bending or kinking point in its middle.

After laterally moving the bending jaw 42, the same preferably is also moved into or out of the drawing plane in order to clear the way for a gripper 60 to be shifted laterally, which can be put into rotation by a motor and also is motorically movable along a guide 62. The guide 62 extends substantially perpendicularly to the longitudinal direction of the wire 30, always based on the condition of the wire in FIG. 1.

The gripper grasps the so-called eye 64, i.e. the kinking point or bending point at its tip and clamps the same.

Figure 3:
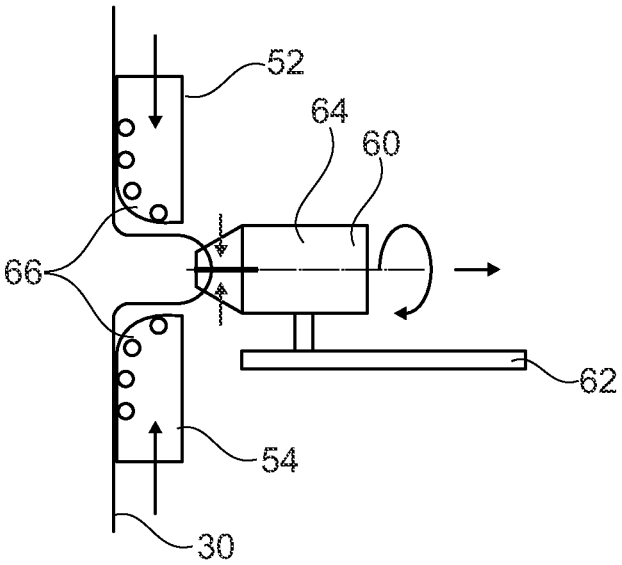
FIG. 3 shows the rotatable gripper when first grasping the kinked wire.

Before or after the grasping of the eye 64 by the gripper 60, the diverters 52, 54 are moved into their operative position as shown in FIG. 3. This operative position approximately corresponds to the operative position of the counter-bracket 44 in FIG. 1 and FIG. 2 at the top.

The diverters 52, 54 can however also be moved from the side, i.e. in the drawing plane or out of the drawing plane.

The diverters 52, 54 are formed with an arc-shaped bending surface 66 that acts as a sliding surface and along which the wire is drawn when the gripper 60 puts the eye 64 into rotation and at the same time pulls it to the right in the direction of arrow (see FIG. 3). Then, the linear wire portions of the two wire halves move along their arc-shaped bending surfaces 66 and are pulled into the space between the diverters 52, 54 and also bent in the process.

The arc-shaped bending surface thus extends over substantially 90°.

In addition, lateral limiters represented by rollers can be present here, which prevent the wire from slipping off the respective bending surface 66.

Figure 4:
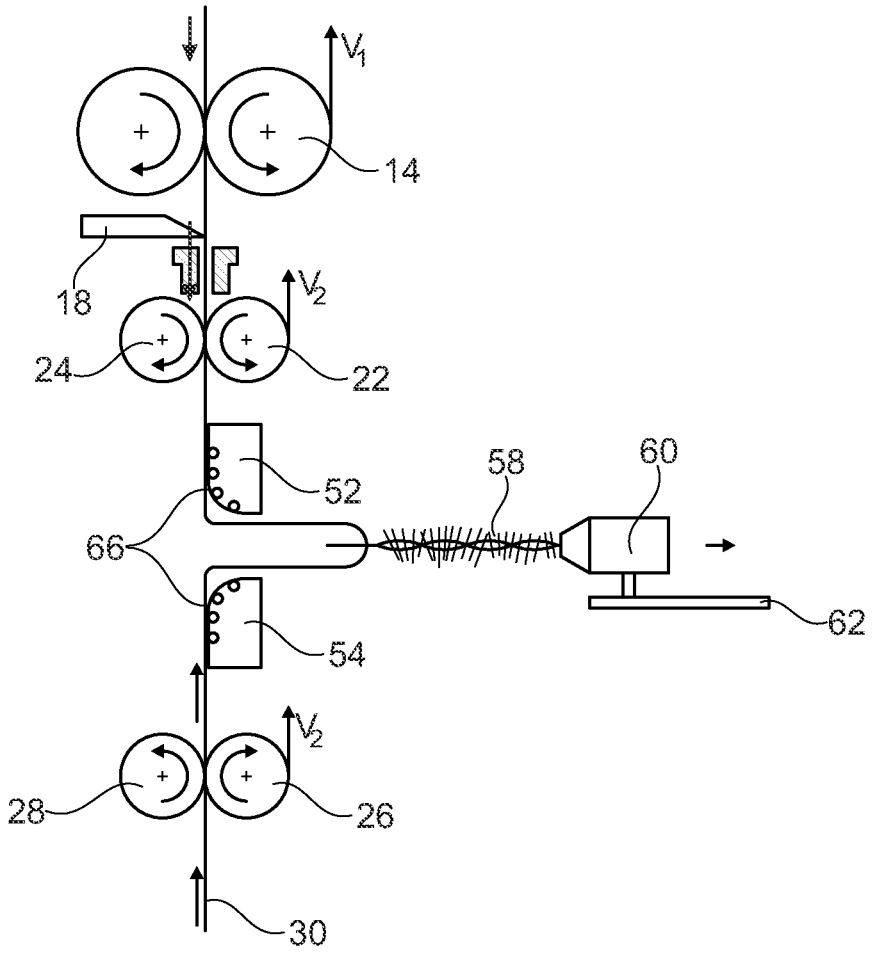
FIG. 4 shows a succeeding step in which the gripper already has twisted a part of the wire.

Subsequently, the wire is pulled further according to FIG. 4, at the same time it is twisted, and at the same time the bristles are introduced between the wire halves and clamped there on twisting.

During the twisting operation the drive rollers 22, 26 are put into movement, wherein they press wire material from the two non-bent ends of the wire halves towards each other in the direction of the diverters 52, 54 and hence towards the gripper 60 pulling the wire. This is necessary, because the propulsive force of the gripper for withdrawing wire is too small to overcome the friction of the wire at the bending surfaces 66 themselves.

The drive of the gripper 60 for rotating in particular is torque-controlled; it can be achieved by a servo motor. In addition, preferably all driven drive rollers likewise employ servo motors, which can be adjusted very well in terms of their speed.

When retracting the wire in FIG. 1, care moreover is taken that the circumferential speed of the drive rollers 22, 26 is the same as the circumferential speed of the auxiliary drive roller 14, so as not to cause any upsetting or pulling of the wire 30.

The diverters 52, 54 are of very simple design, they contain hardened surfaces, hence are to be manufactured from steel very easily and above all are very robust.

This also applies for the bending part and the bending jaws. These parts likewise are very easy to manufacture, above all they also are very easy to adapt to the desired optimum shape. Not every wire must have an identically formed eye, it rather is expedient to optimally design this eye depending on the wire thickness, etc. This adaptation is effected by optimally designed trunnions 40 and counter-brackets 44 including gap 48.

Figure 5:
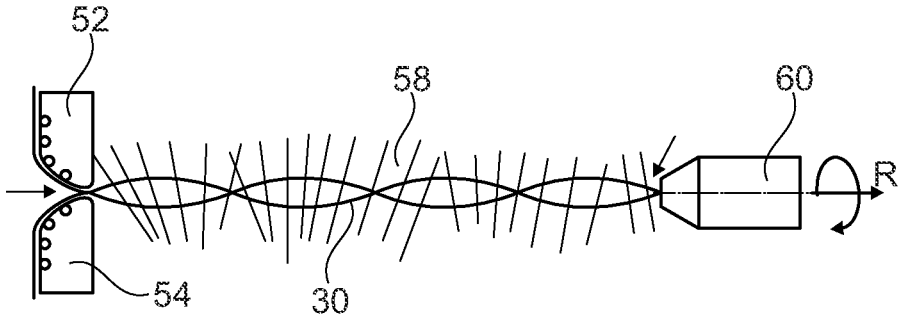
FIG. 5 shows a succeeding step in the apparatus according to the invention, in which the round brush is rotated almost completely.

FIG. 5 shows the end of the twisting process. Up to the end, the drive rollers 22, 26 have pressed the wire in the direction of the gripper 60 until the wire gets out of engagement with the same.

The special feature of the apparatus also is that twisting with the gripper 60 is not effected until reaching the final twisted condition of the round brush. Rather, a very slightly twisted spiral is produced, which is re-twisted in order to achieve the necessary and desired rotation of the wire halves and produce the proper tension. It is just sufficient that the bristles do not fall out of the twisted wire before the round brush is reworked.

The apparatus optionally can be equipped with a finishing station in which the bristles for example are cut (see FIG. 7), where a milling cutter or a knife 70 is moved along the almost finished brush, while the same is rotated. Moreover, an additional twisting can be effected in the finishing station, which bears the reference numeral 72, as indicated already.

Figure 6:
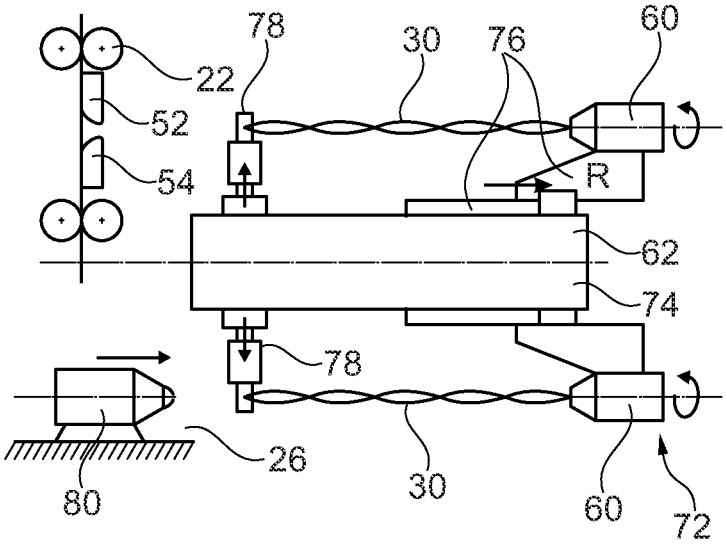
FIG. 6 shows the apparatus according to the invention, which in this embodiment is configured with a finishing station.
Figure 7:
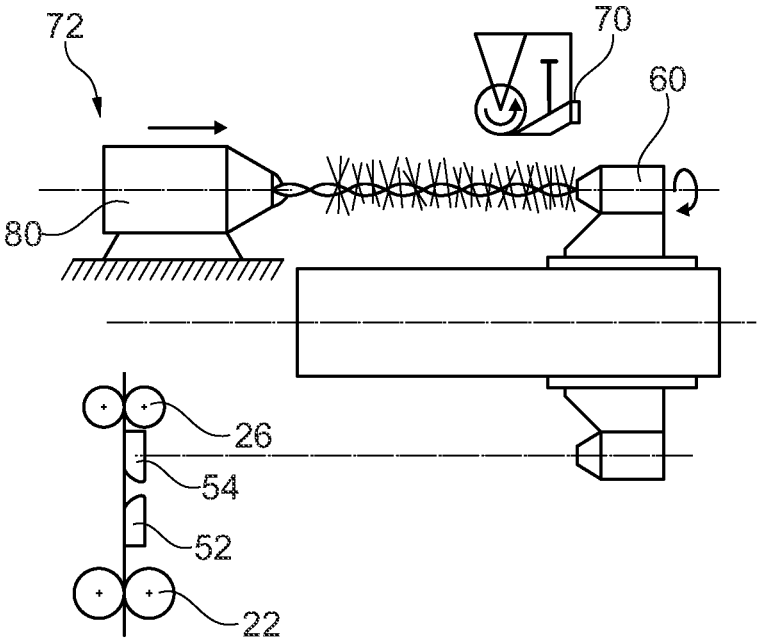
FIG. 7 shows another variant of the apparatus according to the invention, in which the finishing station is configured with a milling cutter or counter-knife for processing the bristles.

To prevent that the wire twisted already must be newly grasped, the apparatus has a rotatable guide, for example a drum on which the gripper 60 is movable. There is shown a base 76 that is moved on the guide 74. Along the base 76, the gripper 60 then is moved in longitudinal direction. On the guide 74 a plurality of rotatable grippers 60 are seated, which can be clocked in and out into various stations. The upper station in FIG. 6 is the feed station, which has just been explained with regard to FIG. 1. An intermediate holder 78 holds the free end of the twisted wire when the same is pulled out of the diverters 52,54. Subsequently, the apparatus is rotated, i.e. the guide 74 or the base 76 itself is rotated so that the rotatable gripper 60 gets into a finishing station 72 along with the intermediate holder 78 and the wire 30. Here, a stationary gripper 80 is seated, which grasps the free ends of the wire 30. The gripper 80 can be shifted in linear direction, as is shown in FIGS. 6 and 7. When the gripper 80 has grasped the free ends, the gripper 60 can rotate again so that twisting is possible. Of course, the gripper 80 might also rotate, which even is expedient for finishing by cutting.

While the brush is completed in the finishing station 72, the next brush already is manufactured in the feed station.

What is claimed is:

1. An apparatus for manufacturing round brushes that include bristles clamped between two wire portions of a folded wire, comprising:

a feed station and a subsequently arranged finishing station;

the feed station having two opposed counter-brackets that are spaced apart from each other, a bristle feeding device and a rotatable gripper;

the feed station being designed to bend a wire, which is transported into the feed station, transversely to a longitudinal direction of the wire between the opposed counter-brackets;

the bristle feeding device being designed to feed bristles to the bent wire, and the rotatable gripper being designed to grasp the bent wire and twist the bent wire during the feeding of the bristles in order to anchor the bristles in the wire;

the finishing station being designed to receive the twisted wire and to further twist the wire and cut the bristles on an outer end of the bristles;

the finishing station having a finishing station gripper that can grasp a free end of the twisted wire;

the apparatus having a rotatable base to which a plurality of rotatable grippers are attached and wherein, by rotating the base, the rotatable gripper together with the wire just twisted can be transferred from the feed station into the finishing station where the wire just twisted is grasped by the finishing station gripper, wherein the rotatable gripper can be put into rotation for the further twisting; and wherein a milling cutter or a knife is provided in the finishing station for cutting the bristles at the outer end.

2. The apparatus according to claim 1, wherein a guide is provided on the base, along which the rotatable gripper is movable by a motor in a longitudinal direction of the guide.

3. The apparatus according to claim 1, wherein the finishing station gripper is designed to rotate during cutting.

4. The apparatus according to claim 1, wherein an intermediate holder for a free end of the twisted wire is provided in the feed station, the intermediate holder together with the wire and the rotatable gripper being rotatable into the finishing station.

5. The apparatus according to claim 4, wherein the wire is bent by pulling the wire when being arranged between the counter-brackets, the intermediate holder being able to hold the wire when the wire is being pulled out between the counter-brackets.

6. The apparatus according to claim 1, wherein the milling cutter or the knife is supported to be displaceable along an outer side of the bristles.

7. The apparatus according to claim 1, wherein the finishing station gripper is arranged in the finishing station to be moved in linear direction of the wire.

8. The apparatus according to claim 1, wherein the rotatable gripper is arranged to grip the bent wire at a bent or kink point of the bent wire.

9. A method of producing round brushes having bristles clamped between two wire portions of a folded wire, the method comprising steps of:

in a feed station, a fed wire is bent transversely to its longitudinal direction between two opposed, spaced-apart counter-brackets and twisted by means of a rotatable gripper, bristles being fed to the bent wire during twisting to anchor them between twisted wire halves, and the twisted wire provided with the bristles is transferred to a finishing station by rotating a rotatable base and the rotatable gripper seated on the base, a finishing station gripper grasps free ends of the twisted wire halves in the finishing station, in the finishing station, the rotatable gripper is rotated to further twist the wire, and the bristles are subsequently cut at their outer ends in the finishing station.

10. The method according to claim 9, wherein the rotatable gripper is moved longitudinally along a guide provided on the base.

11. The method according to claim 9, wherein the finishing station gripper rotates during cutting operation.

12. The method according to claim 9, wherein a free end of the twisted wire is moved by an intermediate holder from the feed station to the finishing station.

13. The method according to claim 12, wherein the intermediate holder holds the wire as it is pulled out between deflection devices between which it is bent by pulling.

14. The method according to claim 9, wherein a milling cutter or a knife is provided in the finishing station for cutting the bristles at the outer end, wherein the milling cutter or the knife is moved along the outer ends of the bristles.

15. The method according to claim 9, wherein the finishing station gripper is moved in a linear direction in the finishing station.

16. The method according to claim 9, wherein the rotatable gripper grasps the bent wire at a bent of kink point of the bent wire.

* * * * *